United States Patent [19]

Swensen et al.

[11] Patent Number: 4,856,175

[45] Date of Patent: Aug. 15, 1989

[54] METHOD OF MANUFACTURING ELEVATED FLOOR PANELS

[75] Inventors: Eugene L. Swensen, Laurel; George F. Ray, III, Rockville, both of Md.

[73] Assignee: USG Interiors, Inc., Chicago, Ill.

[21] Appl. No.: 195,219

[22] Filed: May 18, 1988

Related U.S. Application Data

[63] Continuation-in-part of Ser. No. 905,951, Sep. 11, 1986, Pat. No. 4,753,058.

[51] Int. Cl.[4] ..... B23P 19/04

[52] U.S. Cl. ..... 29/460; 29/446; 29/527.1

[58] Field of Search ..... 29/460, 432, 458, 446, 29/527.1; 52/792, 630, 795, 806, 808, 809; 264/263

[56] References Cited

U.S. PATENT DOCUMENTS

| | | | |
|---|---|---|---|
| 2,391,997 | 1/1946 | Noble | 52/792 X |
| 2,747,651 | 5/1956 | Lighter | 52/792 X |
| 3,011,602 | 12/1961 | Ensrud et al. | 52/792 X |
| 3,050,115 | 8/1962 | Leitzel | 29/460 X |
| 3,258,892 | 7/1966 | Rushton | 52/792 |
| 3,525,663 | 8/1970 | Hale | 52/792 X |
| 3,527,664 | 9/1970 | Hale | 52/792 X |
| 3,876,492 | 4/1975 | Schott | 161/68 |
| 4,411,121 | 10/1983 | Blacklin et al. | 52/792 |

FOREIGN PATENT DOCUMENTS

| | | | |
|---|---|---|---|
| 2051909 | 1/1981 | United Kingdom | 52/792 |

*Primary Examiner*—Timothy V. Eley

*Assistant Examiner*—Peter D. B. Vo

*Attorney, Agent, or Firm*—Pearne, Gordon, McCoy & Granger

[57] ABSTRACT

An elevated floor panel is disclosed in which a lower sheet metal element is formed with a plurality of projections extending from the lower plane of the panel to the upper planar surface. The projections are formed in sequential die drawing operations. In the first die drawing operation, square truncated pyramids of intermediate height are drawn so that the upper surfaces of the intermediate projections provide substantially unworked material. In the second drawing operation, four symmetrically arranged, semispherical projections are drawn from the unworked material at the tops of the preliminary projections. In one embodiment, the tops of the semispherical projections are flattened. In another embodiment, the semispherical projections formed in the second drawing operation are fully curved. In such embodiment, a third operation is performed to produce a flattened extremity. The flattened extremities are welded to an upper sheet member to provide efficient stress transfer between the two sheet metal portions of the panel. By sequentially performing two drawing operations on material which is substantially unworked prior to each drawing operation, it is possible to reliably produce projections of greater depth. The compound projections resulting from the two drawing operations provide a compound beam system which efficiently transfers stress to provide a rigid, strong panel. The cavity between the two members is, in some cases, filled with a lightweight concrete.

24 Claims, 3 Drawing Sheets

METHOD OF MANUFACTURING ELEVATED FLOOR PANELS

BACKGROUND OF THE INVENTION

This application is a continuation-in-part of application Ser. No. 905,951, filed Sept. 11, 1986, Now U.S. Pat. No. 4,753,058.

This invention relates generally to elevated floor panels adapted to be supported at their corners, and more particularly to a novel and improved method for producing elevated floor panels having a lower sheet metal member formed by a multiple draw.

PRIOR ART

Various elevated floor panels are formed by combining a substantially planar sheet metal cover member with a lower or base sheet metal member which has been subjected to die drawing operations to provide an array of projections which extend from the lower surface of the panel to the upper cover member. Such panels provide a beamlike structure in which the cover and base are interconnected at relatively closely spaced intervals to provide a strong, substantially rigid structure. Examples of such floor panels are illustrated in U.S. Letters Pat. Nos. 3,011,602; 3,876,492; and 4,411,121.

It is also known to provide panels with a face or lower sheet metal member which is die-drawn to provide 25 projections each having a shape which is substantially a square, truncated pyramid. Such pyramids are welded along their upper surfaces to the upper or cover sheet. Such panels are often filled with concrete material or the like, and in other instances, such panels are hollow. Such prior art panels, which have been marketed by the assignee of this invention, are die-formed so that the height of the truncated pyramids is greater along the periphery but is substantially less along the central portions of the panels. This arrangement, in which the truncated pyramid projections have substantially less depth along the central portions of the panel, is provided to eliminate problems encountered when attempting to make draws of greater height. Because the depth of the truncated pyramids is reduced along the central portion of the panel, some reduction of strength and rigidity results.

SUMMARY OF THE INVENTION

The present invention provides a novel and improved method for producing such panel.

In accordance with one embodiment of this invention, a lower or base sheet metal member is diedrawn in two operations to provide an array of projections extending substantially the full distance between the plane of the lower panel face and the plane of the upper panel face. During the first drawing operation, projections of intermediate height are formed in such a manner that a relatively large central portion of the metal forming each of the intermediate projections is substantially unworked. Thereafter, in a second drawing operation, such unworked central portions are drawn to form projections extending beyond the intermediate height to provide the required full projection height.

Because the two separate drawing operations are each performed on metal, which prior to the drawing operations is substantially unworked, and because each draw is to a height less than the required total height, satisfactory drawing operations can be reliably performed and projections of greater height are possible.

Further, because the metal thickness of the components of the resultant panel can be maintained substantially uniform, a stronger more rigid panel can be produced from a given thickness of material.

In such one illustrated embodiment, a base sheet of metal is die-drawn to form an array of projections of intermediate height having a shape of a square, truncated pyramid. The upper surface of each pyramid provides a substantially square central portion which is substantially unworked. Such unworked metal is subsequently drawn to form four symmetrically arranged, generally semispherical projections having a flattened upper surface.

A cover member or sheet is then welded to the flattened upper surfaces of the semispherical projections. In some instances, the panels are filled with lightweight concrete material or the like. However, such panels can also be used without such filling material.

In a second illustrated embodiment of this invention, a method is employed utilizing three sequential drawing operations. The first drawing operation again forms an array of truncated pyramids of intermediate height having substantially unworked upper extremities. Such first drawing operation is substantially identical to the first drawing operation of the first embodiment.

In the second drawing operation, the substantially unworked material at the extremities of each of the projections formed in the first drawing operation is again drawn to produce four generally hemispheric projections, which in this embodiment are not flattened at their upper extremities. By forming these semispherical projections with a substantially uniform curvature throughout, the distribution of the deformation of the metal being drawn is more uniform and the semispherical projections have a substantially uniform wall thickness. In fact, even the metal at the very extremity of the semispherical projections is drawn to some extent. Further, by eliminating the flats at the extremity of the semispherical projections in the second drawing operation, the tendency for the metal to crack or tear is virtually eliminated.

In this embodiment, the upper extremities of the semispherical projection extend a small distance above the upper plane of the finished part of the panel.

In a third subsequent operation, a small amount of additional working of the metal forming the semispherical projection is performed to produce the finished flat extremities and to provide relatively sharp corners around the periphery of such flat extremities. This third operation reduces the height of the semispheric projections so that they are flush with the upper plane of the panel part. Since a further stretching of the metal does not occur during this third operation, the tendency for the material to crack or tear is completely eliminated and the finished product has a very uniform wall thickness.

In the illustrated embodiments, the first drawing operation produces 25 truncated pyramids arranged in rows of five having a height of about $\frac{3}{4}$ inch. The subsequent drawing operation or operations produce 100 semispherical projections about $\frac{1}{2}$ inch high. Consequently, the total height of the projections is about $1\frac{1}{4}$ inches. Because the individual drawing operations are of lesser depth, they can be produced reliably with less difficulty. Further, each of the projections is connected to the cover sheet by one or more spot welds so that the cover sheet and the base sheet are interconnected at relatively closely spaced intervals to provide good stress transfer between the two metal parts and good support for the cover sheet.

Further, the combined structural shapes of the projections efficiently function to provide effective stress transfer. The upper spherical projections cooperate to form an upper beam system which is rigid and provides substantial strength. Such upper beam system efficiently transfers stresses from the cover to the upper portions of the truncated pyramids. Such stresses are then supported by the lower beam system provided by the truncated pyramid array. These two beam systems combine to provide a very rigid and strong panel which maximizes the efficient use of the material forming the panel.

In instances in which the panel is filled with a lightweight concrete material or the like, such material extends between the spherical projections and provides a support intermediate the weld which reduces any tendency for dimpling to occur when concentrated loads are applied to the cover sheet. Further, such structure provides improved sound deadening characteristics.

With the present invention, it is possible to produce an improved, elevated floor panel which is stronger and more rigid for a given amount of material required for the production of the panels and to achieve the die drawing operations in a reliable manner without difficulty.

These and other aspects of this invention are illustrated in the accompanying drawings, and are more fully described in the following specification.

DETAILED DESCRIPTION OF THE DRAWINGS

Figure 1:
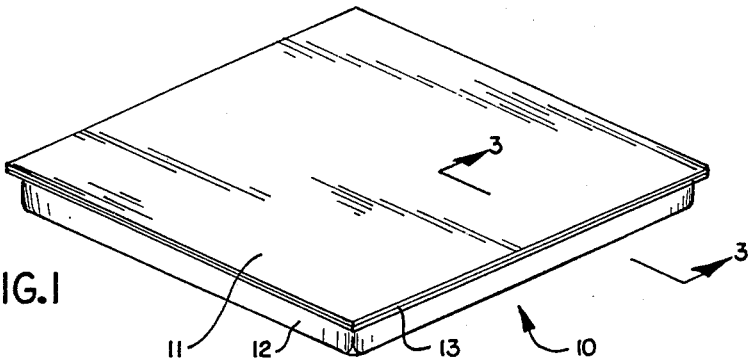
FIG. 1 is a perspective view of a panel incorporating this invention.
Figure 2:
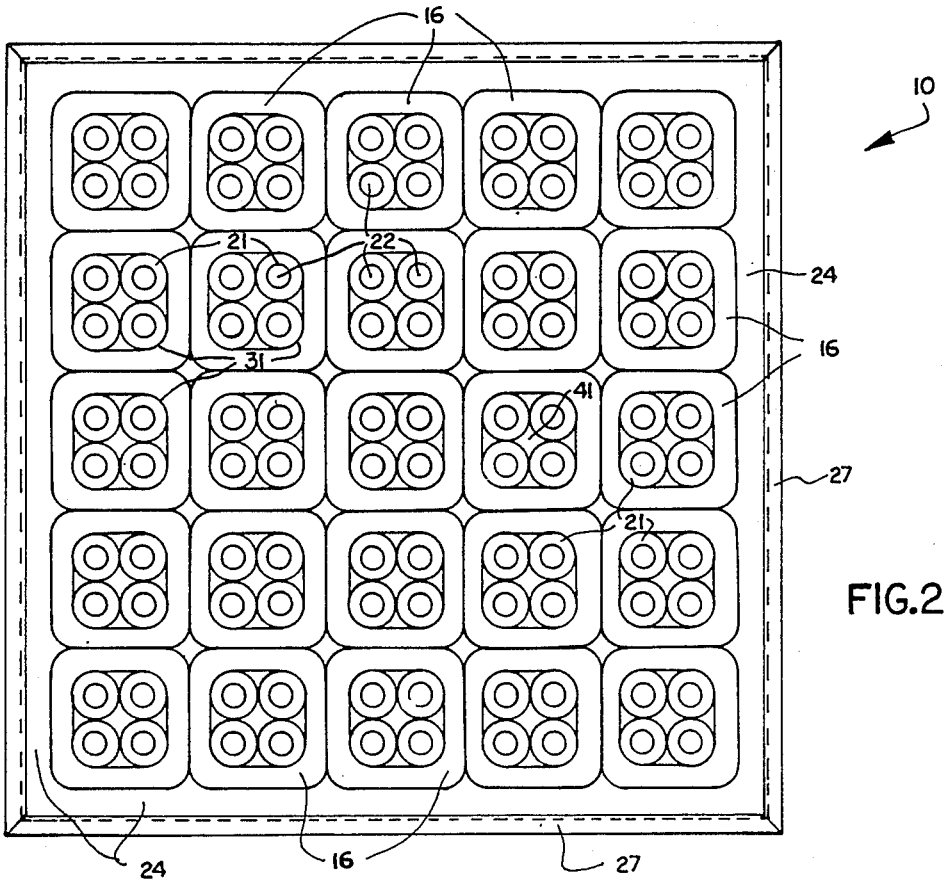
FIG. 2 is a plan view of the base member of a preferred embodiment of this invention, illustrating the arrangement of the projections formed therein.
Figure 3:
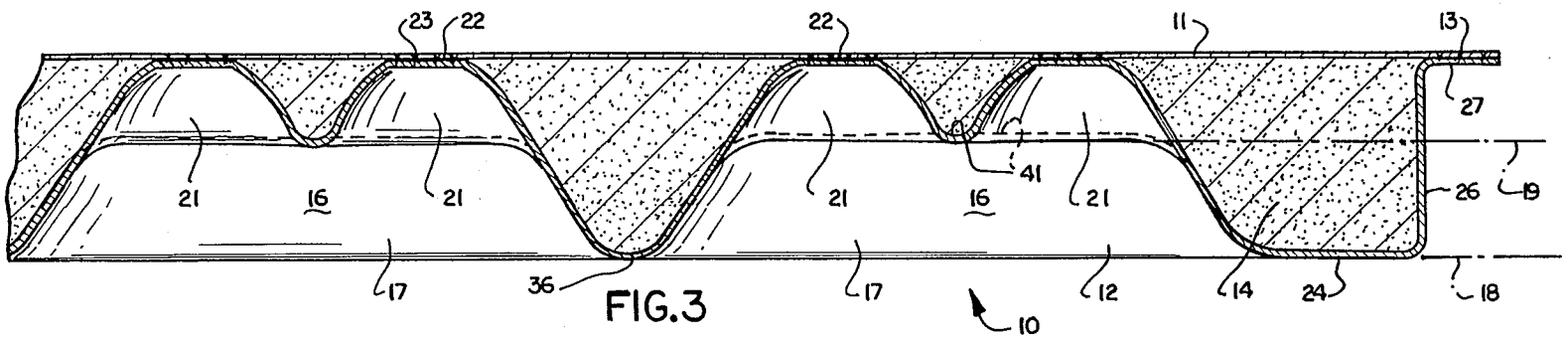
FIG. 3 is an enlarged, fragmentary section of a concrete-filled panel taken along line 3—3 of FIG. 1, and illustrating the shape of the projections.
Figure 4:
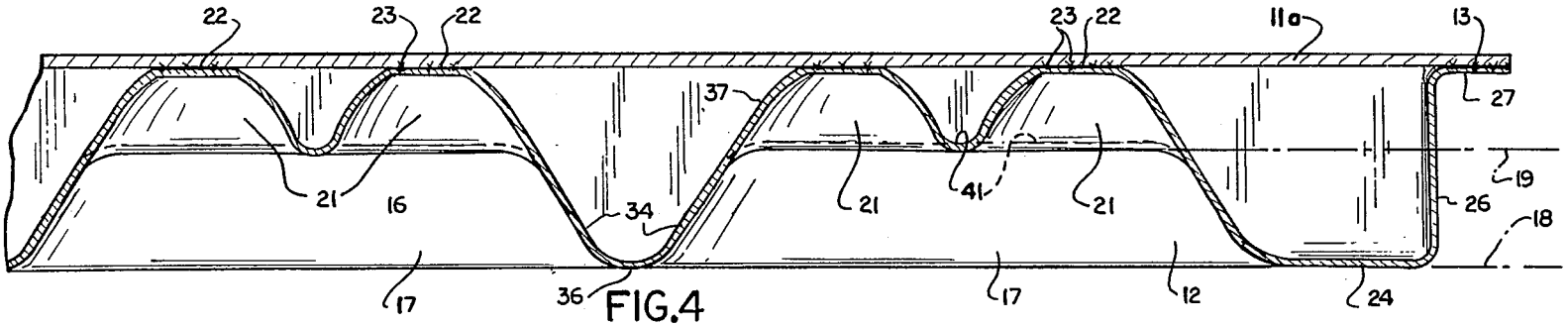
FIG. 4 is an enlarged, fragmentary section, similar to FIG. 3 illustrating a panel that does not include a concrete filler.
Figure 5:
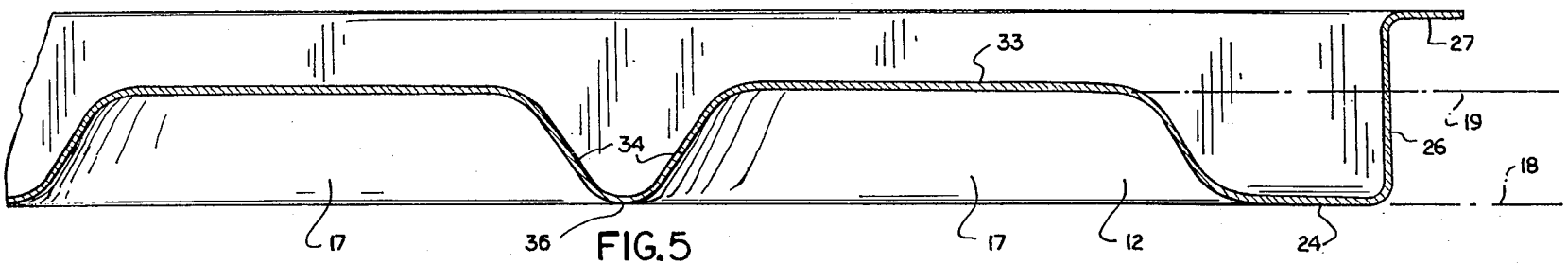
FIG. 5 is a fragmentary section illustrating the base sheet member at the completion of the first drawing operation before the spherical projections are produced by a second drawing operation.
Figure 6:
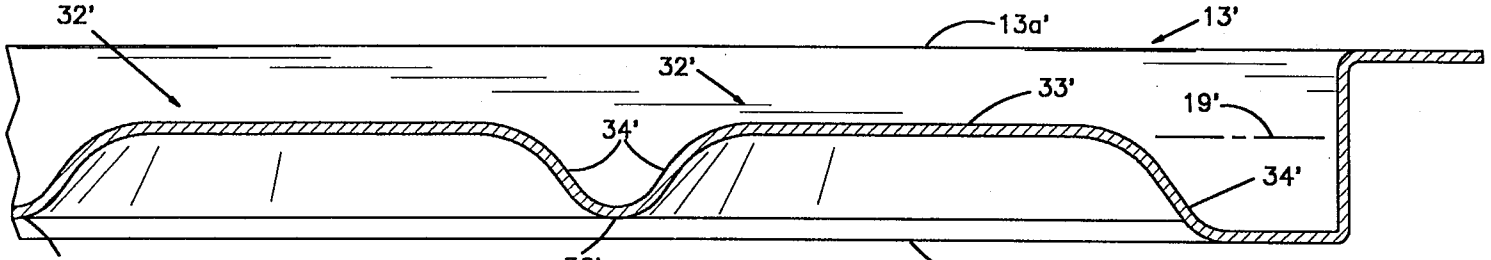
FIG. 6 is a fragmentary cross section of the first drawing operation performed in accordance with the second embodiment of this invention.
Figure 7:
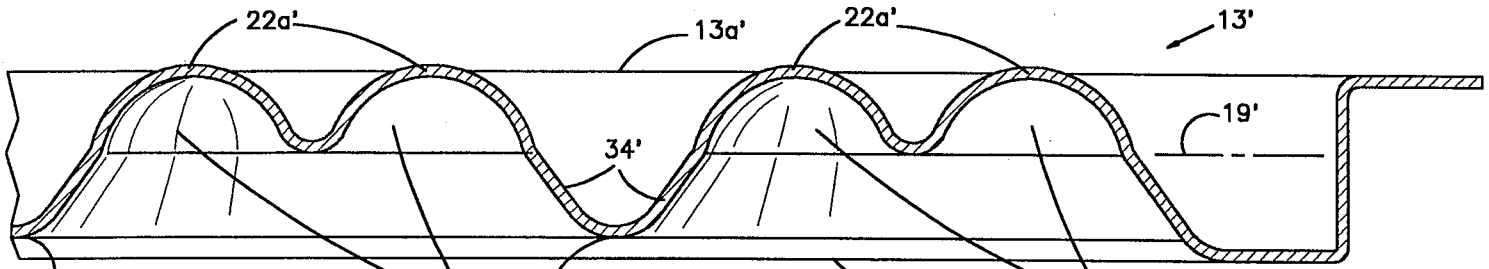
FIG. 7 is a fragmentary section similar to FIG. 6, but illustrating the shape of the projections completed in the second drawing operation of the second embodiment of this invention.
Figure 8:
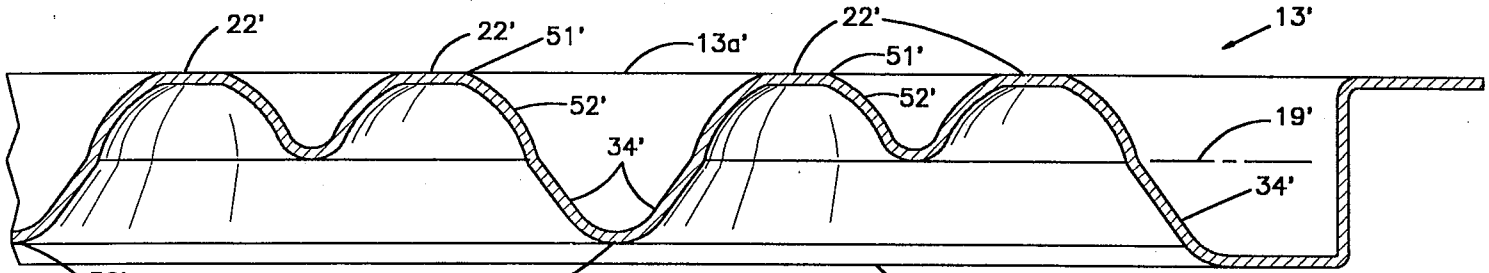
FIG. 8 is a fragmentary cross section similar to FIGS. 6 and 7, illustrating the shape of the base sheet at the completion of the third and final drawing operation in accordance with the second embodiment of this invention.

FIG. 1 illustrates a typical elevated floor panel 10 incorporating the present invention. Such panel is adapted to be supported at its corners on pedestals (not illustrated) and assembled in an array to provide a floor system spaced from the base floor system of a building. The illustrated panel 10 includes an upper cover sheet 11 and a base sheet 12 which are welded along the periphery of the panel at 13 to provide a unitary structure. FIG. 3 illustrates a first embodiment in which the panel is filled. FIG. 4 illustrates a second embodiment in which the panel is unfilled. However, in both the first and second embodiments of FIGS. 3 and 4, the lower or base sheet 12 is formed by a two-step drawing operation, as described in detail below. FIGS. 6 through 8 illustrate a third embodiment in which the lower or base sheet is formed by a three-step drawing operation, also described in detail below. In the first embodiment of this invention, the panel is filled with a lightweight concrete material 14 illustrated in FIG. 3. However, it is also within the scope of this invention to form a panel which is hollow and consists only of the upper and lower sheets 11 and 12, as illustrated in the second embodiment of FIG. 4.

Referring to FIGS. 2 through 5, the base sheet 12 is formed with a plurality of compound projections 16. In the illustrated embodiment, the panel 10 is square and provided with 25 compound projections 16 arranged in an array of perpendicularly extending rows, with each row containing 5 compound projections. It should be understood that the number of rows and the number of projections in each row are not critical to the present invention.

Each of the compound projections 16 includes a lower truncated pyramid portion 17 which extends substantially from a plane 18 extending along the lower side of the panel to an intermediate plane 19. Extending from the intermediate plane 19, each compound projection provides four symmetrically arranged, generally semispherical projection portions 21. Each of these semispherical projection portions 21 provides a flattened upper extremity 22 which is coplanar with the flattened surfaces of the other semispherical projection portions. The cover sheet 11, which is a planar member, is welded to each of the flattened extremities 22 by welds 23 so as to produce a unitary structure.

The rows of projections are spaced inwardly from the side edges of the panel to provide a peripheral wall 24 joining the outermost compound projections 16 to an upstanding side wall 26. Such peripheral wall extends along the plane 18 and is spaced from the upper cover sheet 11 by the full depth of the panel. The upper extremity of the side wall 26 is bent at right angles to provide a peripheral flange 27 engaging the lower side of the cover sheet 11 and welded thereto by the weld 13.

In the embodiment of FIG. 3, the cavity defined by the cover sheet 11 and the base sheet 12 is filled with lightweight concrete 14. Such concrete provides the panel with additional rigidity and supports the cover sheet, resisting the tendency for the cover sheet to dent when relatively concentrated loads are applied thereto. Further, the lightweight concrete provides a substantial amount of sound deadening along substantially the entire surface of the panel, and thereby reduces the tendency for the panel to emit noise characteristic of metal panels if objects are dropped on the panel. Since the concrete 14 provides support for the cover sheet 11, it can be formed of relatively thin material without becoming susceptible to denting and the like. Further, even in the zones where concrete does not exist to support the cover sheet, sufficient strength is provided because a double layer of metal is provided by the flattened extremity 22 in combination with the cover sheet 11.

FIG. 4 illustrates a second embodiment in which the panel is unfilled and remains hollow. In such embodiment, the base sheet is formed in the identical manner as the base sheet of the first embodiment. However, in this embodiment, the cover sheet 11*a* is of thicker gauge so as to provide the necessary resistance to denting under concentrated loads. In both embodiments, however, the cover sheet and the base sheet are interconnected at relatively closely spaced intervals so that good support is provided for the cover sheet along its entire surface and a cooperative beam system is established to provide a high degree of rigidity. Because the welds 23 are located at closely spaced intervals along the entire panel, at 100 locations in the illustrated embodiments, sufficient interconnection is provided to produce good stress transfer between the cover sheet and the base sheet for high strength and rigidity.

Further, because the compound projections are formed with curved surfaces, the tendency for the metal to buckle or bend in localized areas is greatly diminished. It should be noted that in FIG. 2, which illustrates the arrangement of the array of projections, even the corners 31 of the truncated pyramid portions are rounded to minimize sharp corners which could produce problems in the forming of the projections, and which could create localized stress conditions which could result in buckling and the like.

In accordance with the first and second embodiments illustrated in FIGS. 3 and 4 of this invention, the compound projections 16 in the base sheet are formed in two sequential drawing operations. At the completion of the first drawing operation illustrated in FIG. 5, the base sheet is provided with 25 projections arranged in rows of 5, in which each projection is in the shape of a square, truncated pyramid 32. The upper surface or second portion 33 of such pyramids 32 is flat and substantially unworked during the first drawing operation. During the forming operation in which the truncated pyramids 32 are produced, the metal of the side wall or first portion 34 is stretched beyond its elastic limit and is thinned to some extent. Further, such metal tends to be work-hardened. Preferably, the angle of the side walls 34 is selected so that such side walls are sloped to a substantial extent. This ensures that a substantial amount of metal is available for the drawing operation in which the side walls 34 are formed.

The lower ends of the side walls 34 are formed with ample radius so that a smooth transition is provided between the material at the base 36 of the side walls 26 and also to retain a substantial amount of metal between the projections at the lower plane 18. In the first and second embodiments, the total depth of the panel is about $1\frac{1}{4}$ inches, and the height of the truncated pyramids is about $\frac{3}{4}$ inch. Therefore, the upper surface 33 of each pyramid extends along the intermediate plane 19 spaced from the plane 18 by about $\frac{3}{4}$ inch. Those skilled in the art will recognize that the drawing of the metal to produce the truncated pyramids can be performed reliably without great difficulty because such draw is relatively shallow.

During a second drawing operation, the material of the upper surface or second portion 33 of each truncated pyramid which is substantially unworked during the first drawing operation is subsequently drawn in dies to form the substantially semispherical projecting portions 21. Here again, the depth of the second drawing operation used to form the generally spherical projections 21 is relatively small. In this illustrated embodiment, the spherical projections have a total height of only $\frac{1}{2}$ inch. However, the total height of the compound projections 16 is $1\frac{1}{4}$ inches. Therefore, relatively high projections are produced without subjecting the material of the base sheet to deep drawing operations. Because the metal which is drawn during the second operation is substantially unworked during the first drawing operation, the second drawing operation is performed on substantially virgin material which has not been previously work-hardened or thinned.

Further, with the two drawing operations, better control of the stretching of the metal is provided because a large area of metal is not being drawn during a given drawing operation.

Because each of the compound projections extends substantially the full distance between the lower plane 18 and the plane of the upper sheet 11, the panel has a good moment of inertia and the ability to support substantial loads on the upper surface of the panel with a minimum amount of deflection. Because the outermost rows of the compound projections are spaced from the side walls 26, a substantial amount of metal is provided at the upper and lower surfaces of the panel to support edge loading of the panel where the greatest stresses occur for a given load on the panel. The semispherical projections are shaped so that the lower extremities of the adjacent portions of their side walls 37 are in substantial alignment with the side walls 34 of the truncated pyramid portion of the compound projection. Therefore, the curved portions or corners 31 at the corners of the truncated pyramids blend into the associated portions of the side walls 37 of the spherical projections. Because the compound projections provide compound curves, as mentioned above, there is very little tendency for the material forming the compound projections to buckle under loading conditions.

Further, the semispherical projections 21 cooperate with the cover sheet 11 or 11*a* to provide an upper beam system shaped to provide for the effective support of the cover 11 or 11*a* and to transfer stress to the upper extremity of the truncated pyramids. Such upper beam system includes compound curved surfaces provided by the semispherical projections themselves and the portion 41 of the surface 33 which remains in the plane 19 after the second drawing operation. Such portion 41 is spaced from and is substantially parallel to the cover 11 and cooperates therewith to provide an upper beam system at the upper extremity of each compound projection 16 which is strong and rigid. Therefore, the upper beam system efficiently transfers stress to the upper extremities of the truncated pyramids 17.

The truncated pyramids cooperate to provide a lower beam system which combines with the upper beam system to provide a combined beam system of substantial depth for supporting the loads applied to the covers 11 or 11*a*. Because these beam systems cooperate to provide a combined beam system of substantially full panel depth over the entire panel, higher loads can be satisfactorily supported for a given amount of material forming the panel.

Reference should now be made to FIGS. 6, 7, and 8, which illustrate a third embodiment of the invention in which three forming steps are provided. In this embodiment, similar reference numerals are used to indicate parts which correspond to parts in the first embodiment, but a prime is added to signify that reference is being made to the third embodiment.

The shape of the base sheet 13' at the completion of the first operation is illustrated in FIG. 6. Here again, the base sheet is provided with 25 projections in which each projections is in the shape of a square, truncated pyramid 32'. The upper surface or second portion 33' of such pyramids 32' is flat and substantially unworked during the first drawing operation. Here again, during the forming operation in which the truncated pyramids 32' are produced, the metal of the side wall or first portion 34' is stretched beyond its elastic limit and is thinned to some extent. Also, the lower ends of the side walls 34' are formed with an ample radius so that a smooth transition is provided between the material at the base 36' of the side walls. This also retains a substantial amount of metal between the projections substantially at the lower plane 18'. In this embodiment, however, the base 36' joining the side walls 26' is spaced a small distance above the plane so that the depth of the draw required to form the truncated pyramids 32' is reduced slightly in height. It should be recognized, however, that these base portions 36' are substantially along the lower plane of the panel and extend substantially straight across the panels perpendicular to the side edges of the panel to provide a strong array of beams in the finished panel.

The upper surfaces 33' of each pyramid extend along an intermediate plane 19' spaced from the end parallel to the plane 18'.

During a second drawing operation, the material of the upper surface or second portion 33' of each truncated pyramid, which is substantially unworked during the first drawing operation, is subsequently drawn in dies to form substantially semispherical projecting portions 21', as best illustrated in FIG. 7. Here again, the depth of the second drawing operation used to form the generally spherical projections 21' is relatively shallow. Because the metal which is drawn during the second operation is substantially unworked during the first drawing operation, the second drawing operation is performed on substantially virgin material which is not previously work-hardened or thinned.

In this embodiment, however, the second drawing operation does not produce flats at the tops of the semispherical projections 21'. Instead, the walls forming the semispherical projections 21' are curved throughout their entire extent. By producing the semispherical projections in this way, a more uniform deformation of the material forming such projections is obtained. In fact, during this second operation, the material of the projections is substantially uniformly deformed even along the upper extremities. At the completion of the second drawing operation, the upper extremities **22*a'* extend slightly above the plane 13*a'*** of the flanges.

During a third operation, the extremities **22*a'* of the semispherical projections 21' are further deformed back flush with the plane 13*a'* to provide a flattened extremity 22' which is subsequently welded to the upper sheet of the panel. During this third and last forming operation, the height of the semi-spherical projection 21' is decreased slightly and flattened, and relatively sharp radiused corners 51' are provided at the junction between the flattened extremity 22' and the side walls 52' of the semi-spherical projections. Because the metal is not stretched during the third operation, the tendency for the material to crack or tear at the corners around the flattened extremity 22'** is eliminated.

By utilizing two sequential forming operations illustrated in FIGS. 7 and 8 to produce the semispherical projections, a more uniform deformation of the material forming such projections is accomplished and a more uniform wall thickness is maintained. This results in improved strength in the final product. Preferably, the tool used to form the flattened extremity is semispherical around the flattened end so that a compound curved surface is provided adjacent to the flattened extremity 22'.

With the present invention, it is possible to reliably produce an improved panel having a high degree of rigidity with metal of minimum thickness so that the material cost of producing the panel is minimized.

Although the preferred embodiments of this invention have been shown and described, it should be understood that various modifications and rearrangements of the parts may be resorted to without departing from the scope of the invention as disclosed and claimed herein.

What is claimed is:

1. A method of producing sheet metal elevated floor panels having an upper sheet and a lower sheet wherein the lower sheet provides an array of projections extending to the upper sheet, comprising in a first operation drawing in said lower sheet preliminary projections to an intermediate depth by stretching a first portion of the sheet metal while leaving a flat second portion adjacent to said first portion unworked, subsequently drawing said second portion in a second operation to form secondary projections having a depth greater than one-half of said intermediate depth to increase the depth of said projections, said first and second operations being performed so that the thickness of the metal forming said projections is substantially uniform, and thereafter connecting said upper sheet to said secondary projections.

2. A method as set forth in claim 1, wherein said first portion is substantially unworked during said subsequent forming operation.

3. A method as set forth in claim 1, including performing said subsequent forming operation in sequential second and third drawing operations.

4. A method as set forth in claim 1, wherein said first operation is performed so that said first portion of said lower sheet is substantially annular and said second portion is located within said first portion at the extremity of said preliminary projections.

5. A method as set forth in claim 4, wherein said subsequent forming operation produces a plurality of separate secondary projections extending beyond said preliminary projections.

6. A method as set forth in claim 5, wherein said preliminary projections are formed as truncated pyramids.

7. A method as set forth in claim 6, wherein said secondary projections are symmetrically arranged along the top of said preliminary projections.

8. A method as set forth in claim 7, wherein said secondary projections are substantially semispherical.

9. A method as set forth in claim 8, including performing said subsequent forming operation so that said secondary projections are formed with flattened extremities.

10. A method as set forth in claim 9, including welding said upper sheet to said flattened extremities.

11. A method as set forth in claim 9, including performing said subsequent forming operation in a single drawing operation.

12. A method as set forth in claim 9, including performing said subsequent forming operation in second and third operations, said second operation being performed to produce said semispherical projections having curved extremities and a substantially uniform wall thickness, said third operation being performed to flatten the extremities of said semispherical projections.

13. A method as set forth in claim 12, including forming said flattened extremities without increasing the height of said semispherical projections.

14. A method as set forth in claim 13, including forming said flattened extremities by reducing the height of said semispherical projections.

15. A method of producing elevated floor panels with a sheet metal upper sheet and a sheet metal lower sheet connected to said upper sheet by an array of projections, comprising the steps of die-drawing said lower sheet to produce an array of preliminary projections of intermediate height by stretching a portion of the metal of said lower sheet to provide substantially uniform thickness inclined side walls of said preliminary projections and leaving a second portion of said lower sheet adjacent to said first portion flat and substantially unworked, and thereafter die-forming said lower sheet to increase the depth of said projections by stretching said second portions without substantially reworking said first portions to produce secondary projections having substantially uniform wall thickness and having a height exceeding one-half of said intermediate height, and thereafter connecting said projections to said upper sheet.

16. A method as set forth in claim 15, including welding said projections to said upper sheet to provide said connection.

17. A method as set forth in claim 16, wherein said preliminary projections are formed as square truncated pyramids arranged in an array of rows extending perpendicular to each other and said second portions extend from said preliminary projections.

18. A method as set forth in claim 17, including deforming a plurality of substantially semispherical projections in said second portions.

19. A method as set forth in claim 18, including producing said substantially semispherical projections with flattened portions at the extremities thereof.

20. A method as set forth in claim 19, including performing said subsequent deforming in a single die forming operation.

21. A method as set forth in claim 19, including connecting said upper and lower sheets to define a cavity therebetween, and filling said cavity between said upper and lower sheets with a settable material.

22. A method as set forth in claim 19, including connecting said upper and lower sheets to define a cavity therebetween, and filling said cavity between said upper and lower sheets with cementitious material.

23. A method as set forth in claim 19, including performing said subsequent forming in at least two subsequent die forming operations.

24. A method as set forth in claim 23, including performing a second die forming operation to produce generally semispherical projections having curved extremities, and thereafter flattening said extremities of said generally spherical projections.

* * * * *